US005820475A

United States Patent [19]

Luna

[11] Patent Number: 5,820,475

[45] Date of Patent: Oct. 13, 1998

[54] COMPACT GOLF BALL TEEING MACHINE

[76] Inventor: Antonio A. Luna, 863 N. Barcelona Pl., Walnut, Calif. 91789

[21] Appl. No.: 961,286

[22] Filed: Oct. 30, 1997

[51] Int. Cl.[6] ..... A63B 57/00

[52] U.S. Cl. ..... 473/137

[58] Field of Search ..... 473/132, 133, 473/134, 135, 136, 137, 387

[56] References Cited

U.S. PATENT DOCUMENTS

| | | | |
|---|---|---|---|
| 2,071,356 | 2/1937 | Pagett . | |
| 2,171,299 | 8/1939 | Beckett . | |
| 3,003,770 | 10/1961 | Jones . | |
| 3,738,662 | 6/1973 | Hodgin . | |
| 4,265,453 | 5/1981 | Loof . | |
| 4,796,893 | 1/1989 | Choi | 473/137 |
| 5,326,107 | 7/1994 | Park | 473/132 |
| 5,464,223 | 11/1995 | Dermott . | |
| 5,549,518 | 8/1996 | Wang | 473/137 |
| 5,582,325 | 12/1996 | Janier | 473/137 |
| 5,683,305 | 11/1997 | Andersson | 473/132 |
| 5,743,804 | 4/1998 | Bacon | 473/132 |

*Primary Examiner*—Steven B. Wong

[57] ABSTRACT

Abstract: A portable golf ball teeing machine which comprises of a golf ball tray (11), a foldable forward bracket (22) and rear bracket (29), a removable teeing arm (77), an alignment mechanism for aligning the tee ring (78) to a rubber tee (47). The golf ball tray (11) contains a teeing arm channel (83) wherein the teeing arm (77) completely fits within the golf ball tray (11). The golf ball tray (11) is slanted such that a plurality of golf balls (48) rest to the rightmost, bottom corner (13). The golf ball tray (11) also contains a corrugated guards walls (17) which arranges the plurality golf balls (48) in an alternating order. The teeing arm (77) is a counter-weighted pivoting arm which pivots upon the introduction of a golf ball (51) to a ball receiving plate (85) and lines up the golf ball (51) to a rubber tee (47). Upon teeing up the golf ball (51) into the rubber tee (47), the teeing arm (77) pivots out of the way. The A golf club (49) is utilized to move a golf ball (48) on the golf ball tray (11) into the ball receiving plate (85). The alignment mechanism consists of an alignment arm (46), mushroom head tape (84) (available from 3M of St. Paul, Minn.), and tee alignment adapter (40). The tee alignment adapter (40) attaches to the forward bracket (22) in a fully-deployed configuration.

12 Claims, 7 Drawing Sheets

COMPACT GOLF BALL TEEING MACHINE

BACKGROUND

1. Field of Invention

Golfers frequently go to driving ranges to practice their golf swing. Hitting a golf ball off a tee is a common practice in a golf game. When hitting a golf ball off an artificial turf in a golf range, usually there is a hole in the artificial turf for a rubber tee to slip into. Golfers would repeatedly hit golf balls off the tee to practice this particular aspect of the game. Over the span of time the game of golf has been played, people have come up with numerous inventions in helping golfers to eliminate the repeated and tedious task of teeing golf balls to a tee.

There are two types of teeing machines: one, below-the-ground teeing machine, and two, above-the-ground teeing machine. The below-the-ground design is more elaborate and permanently installed at the golf ranges. The above-the-ground design can either be permanent or portable. Even though there are numerous portable above-the-ground inventions, existing inventions are not prevalent in golf ranges due to a number of limitations.

This improved teeing machine is a portable above-the-ground design that addresses the limitations of existing portable above-the-ground designs.

2. Discussion of Prior Art

This invention is a portable above-the-ground design. The known portable above-the-ground designs have the following disadvantages:

a) Previous patents claim theirs are the lightest and the most portable. The previous designs are still bulky or heavy to be stowed away in a car trunk. Golfers would have reservations about carrying with them the teeing machines to the driving range.

b) Existing designs of teeing machine has limited disassembly for stowing. The existing designs are not fully collapsible for convenient handling and stowing.

c) Existing designs of teeing machine only tee up golf balls into a tee.

d) Existing designs have numerous piece parts. Numerous piece parts translate into higher manufacturing cost and more likely to breakdown or malfunction.

e) Some inventions mention about utilizing a ball hopper to feed the teeing machine. Ball hoppers are known to clog up and a golfer has to unclog the hopper from time to time which makes it inconvenient for a golfer.

f) Some existing designs have to be either bolted down into a ground or made the base of the teeing machine heavy to make it stable.

g) Some teeing machines utilize electric motors, electric motors are either powered by batteries or alternating current supply. Batteries run out of energy and power outlets are not readily available at driving ranges.

U.S. Pat. No. 5582325 to Janier (1996), a patent on a portable teeing machine, also has the following disadvantages:

a) It utilizes a torsion spring to rotate an arm from a horizontal teeing position to vertical position. The torsion spring provides a near constant torque to the arm. The torque that is needed to rotate the arm in the horizontal position is greater than the torque that is needed when the arm is close to the vertical position. The arm, as it rotates to vertical position after teeing up a golf ball, would slam into its housing because the net torque acting on the arm goes up as the arm approaches the vertical position.

b) It utilizes a golf club head to lower the arm to tee up a golf ball. Golfers has to be extra careful in guiding the arm with their golf clubs to the horizontal teeing position and they have to hold down the arm a little longer until a golf ball is fully seated to a tee. This is the last thing golfers need—to be extra careful in guiding the arm, when golfers should be worrying more about their golf shots.

c) Its housing holds very few golf balls. The design of the ball tray works great for few golf balls but making the housing bigger to hold more golf balls will result in balls clogging up at the bottom of the housing. A greater number of golf balls is more likely to clog up at the bottom of the housing, where golf balls are funneled into a smaller channel, because the forces on the bottom of the housing is greater than with the forces with lesser number of golf balls.

d) The teeing machine is not very stable. The width of the housing is slightly bigger than the width of two golf balls. In one embodiment, an upstream hook hinges to a golf ball bucket for stability. Golf ball buckets usually are not stable because the diameter of the bucket's base is smaller than the bucket's upper portion. Even in an embodiment where a rear bracket supports the back section of the golf tray, the teeing machine gets out of alignment with a tee when the arm slams back into its housing.

OBJECTS AND ADVANTAGE

The main object of this invention is to provide a novel and improved teeing machine which is reliable in operation, light-weight, portable, has relatively few parts, low-profile, non-obtrusive, and maintenance-free. The machine furnishes a ball on a tee or ground.

The following are the advantages of this teeing machine:

a) In a stow-away position, this teeing machine collapses into approximately 17.5 inches by 8.0 inches by 2.0 inches. The teeing arm comes off the golf ball tray and slips into a channel in the golf ball tray which is especially designed for the teeing arm to fit into. The brackets, which support the golf ball tray, fold underneath the golf ball tray. An alignment arm, which aligns the teeing machine to a tee, is secured neatly in the golf tray.

b) The teeing machine approximately weighs less than 2 pounds and it does not have to be bolted down to the ground to secure it. Previous designs have to be either permanently mounted or secured in golf ranges. Previous designs are also bulky, heavy, and costly to manufacture.

c) The light-weight and small packaging in a stow-away configuration makes this teeing machine portable. Unlike other teeing machine designs, this teeing machine fits most golf bags. Golfers can opt to leave this teeing machine in their golf bags just like they would leave their golf clubs in their bags.

d) Setting up and tearing down this teeing machine is easily done and there are no tools required. The teeing machine can be easily assembled and disassembled in minutes.

e) This machine has relatively few parts, thus making it very cost effective to manufacture.

f) This machine can either tee up a golf ball to a tee or dispense a golf ball to a mat or ground.

g) Utilizing a ground penetrating tee, this teeing machine can be used on a grass or dirt range.

List of Reference Numerals

| | |
|---|---|
| 1 golf ball tray | 28 lock tab |
| 12 tray bed | 29 rear bracket |
| 13 rightmost, bottom corner | 30 upper bracket leg |
| 14 tray hump | 31 lower bracket leg |
| 15 lock holes | 32 rear bracket foot |
| 16 lock holes | 33 teeing chamber |
| 17 corrugated guard walls | 34 chamber bed |
| 18 guard walls | 35 chamber ramp |
| 19 dividing wall | 36 teeing trough |
| 20 guiding rail | 37 teeing chamber stop |
| 21 guide stop | 38 alignment tab |
| 22 forward bracket | 39 tab keys |
| 23 bracket wall | 40 tee alignment adapter |
| 24 bracket bed | 41 adapter slot |
| 25 bracket rib | 42 adapter keys |
| 26 forward bracket foot | 43 adapter base |
| 27 lock tab | 44 alignment adapter channel |
| 45 hook and loop tape | 74 ground |
| 46 alignment arm | 75 teeing arm pivot support |
| 47 rubber tee | 77 teeing arm |
| 49 golf club | 78 tee ring |
| 49a golf club head | 78a fixed half ring |
| 50 golf club face | 78b pivoting half ring |
| 51 golf ball | 78c ring notch |
| 52 golf ball | 78d ring pivot |
| 53 golf ball | 78e ring pivot hole |
| 54 golf ball | 78f ring lock |
| 55 golf ball | 79 ring inner diameter |
| 56 golf ball | 80 teeing arm stop tab |
| 57 golf ball | 81 teeing arm height adjustment screw |
| 58 golf ball | 82 teeing arm comer |
| 60 golf balls | 83 teeing arm channel |
| 61 bracket pivot tabs | 84 mushroom head tape |
| 62 forward bracket pivot holes | 85 ball receiving plate |
| 63 rear bracket pivot holes | 86 delivery trough |
| 64 golf tray support rib | 87 delivery plate |
| 65 forward bracket support rib | 88 delivery wall |
| 66 rear bracket support rib | 89 ball receiving lip |
| 67 forward bracket stop | 90 plate support |
| 68 rear bracket stops | 91 counterweight housing |
| 69 hook adhesive tape | 92 counterweight |
| 70 loop adhesive tape | 93 pivot |
| 71 tee hole | 94 counterweight housing support |
| 72 mat | |

SUMMARY

The present invention is an improved teeing machine which comprises of a golf ball tray, front and rear brackets, pivotally mounted teeing arm, and an alignment mechanism for lining up a rubber tee to the teeing arm.

DESCRIPTION OF INVENTION

Figure 2:
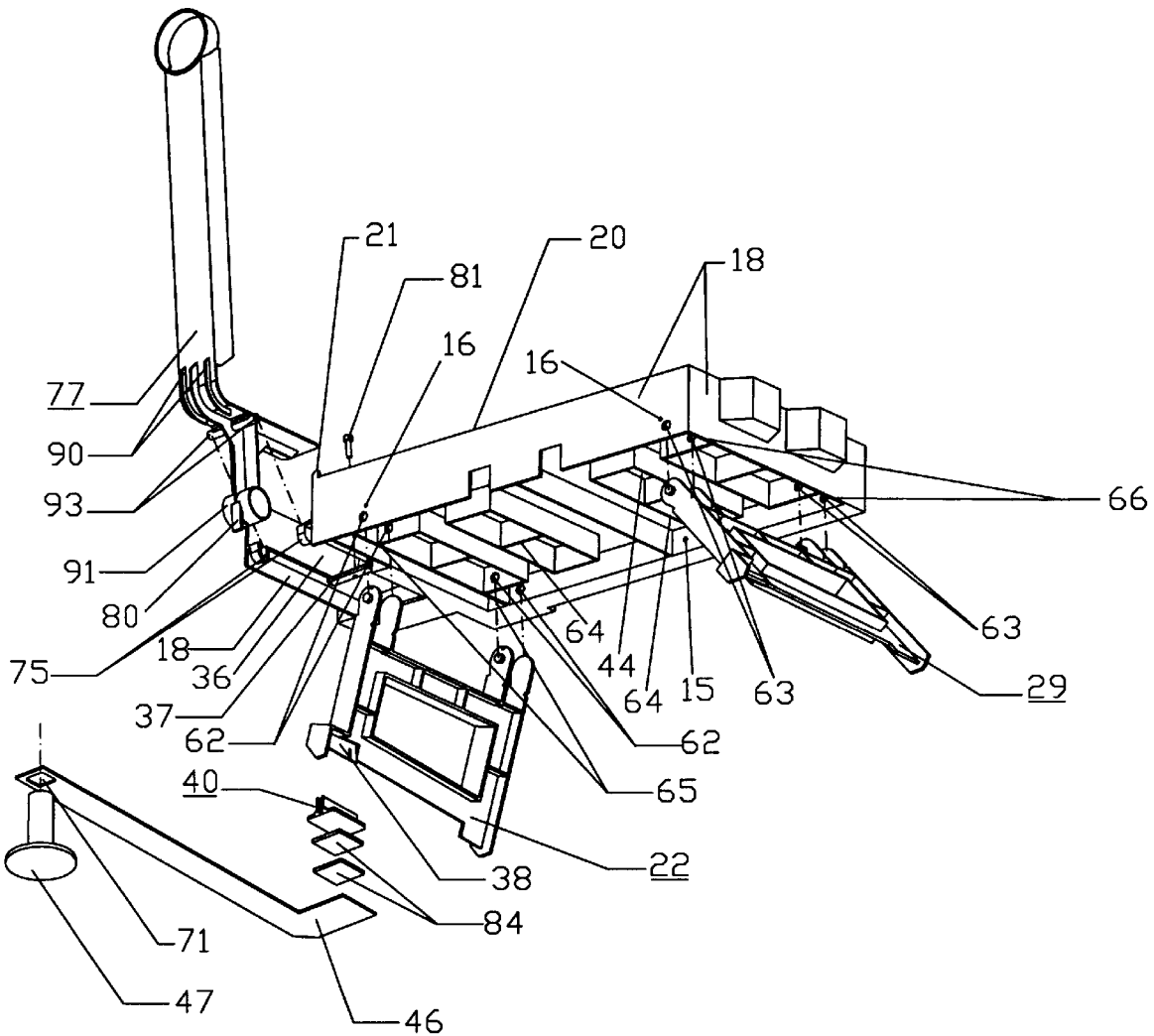
FIG. 2 show an isometric, exploded view of the bottom of golf ball tray.

FIG. I shows a perspective view of a fully-deployed configuration of the improved teeing machine. One of the components of the improved teeing machine is a golf ball tray 11. The golf ball tray 11 is generally rectangular in shape. The golf ball tray 11 is supported by forward bracket 22 and rear bracket 29. In FIG. 2, the left end of the golf ball tray 11 comprises of a teeing chamber 33. The foot of the forward bracket 22 comprises of an alignment tab 38. The alignment tab 38 attaches to a tee alignment adapter 40. One end of an alignment arm 46 is secured to the tee alignment adapter 40 through a mushroom head tape 84—available from 3M of St. Paul, Minn. The other end of the alignment arm 46 comprises of a tee hole 71 where a rubber tee 47 is installed.

Figure 1:
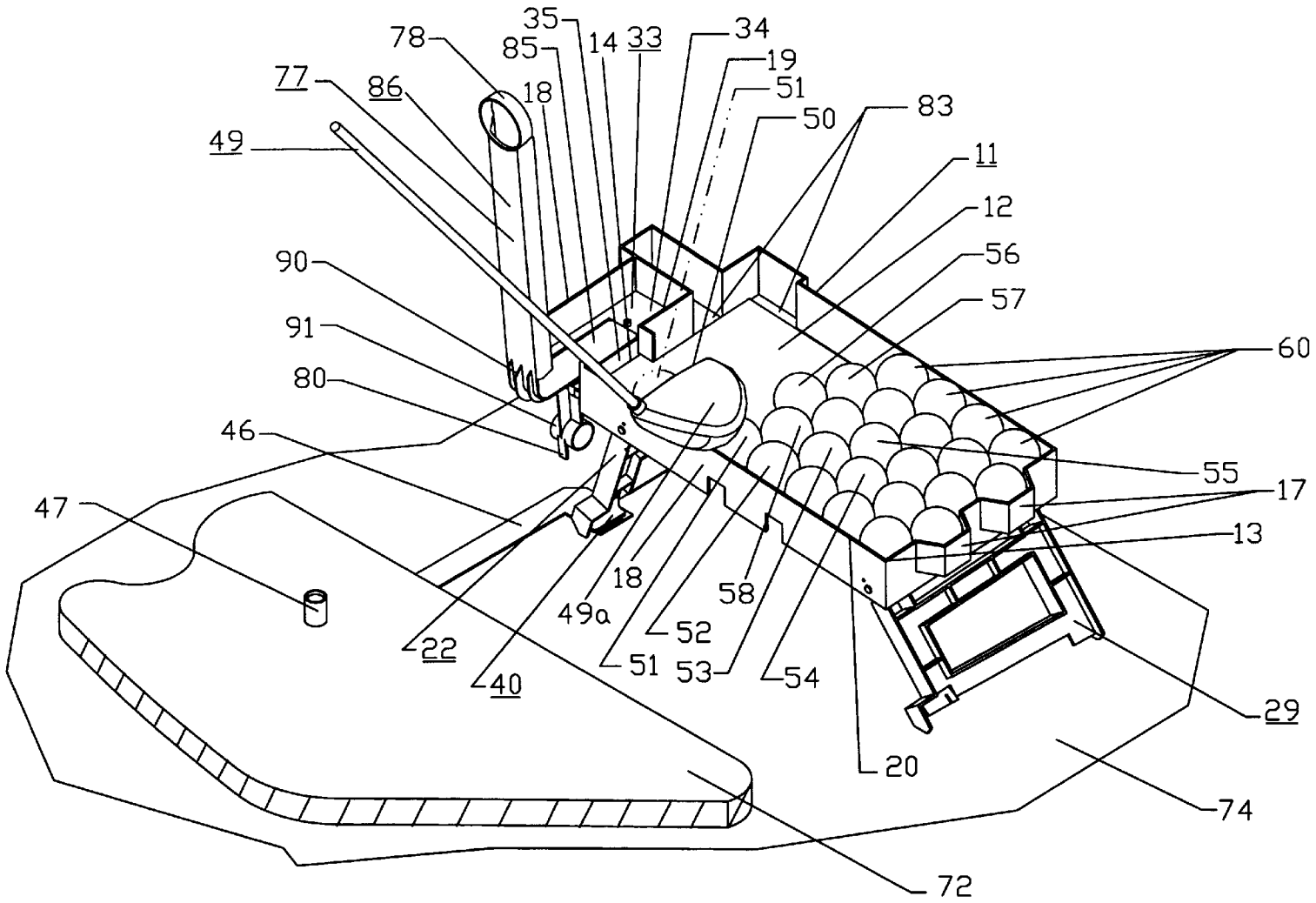
FIG. 1 shows an isometric view of the improved teeing machine.
Figure 6A:
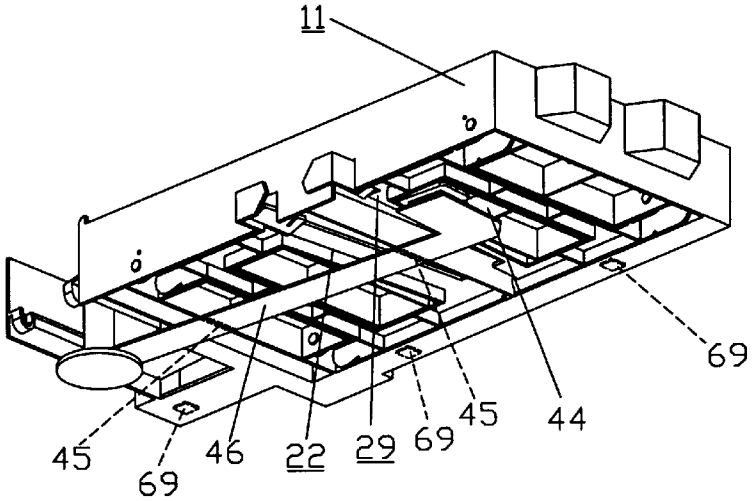
FIG. 6*a* shows isometric bottom view of the improved teeing machined in a stow-away configuration.

In FIG. 1, the golf ball tray 11 comprises of a tray bed 12. The tray bed 12 has a flat surface and it is inclined towards a golfer and in a downward angle away from the teeing chamber 33 such that a plurality of golf balls sitting on top of the tray bed 12 settle to the rightmost, bottom corner 13 of the golf ball tray 11. A corrugated guard wall 17 is located to the right side of the golf ball tray I1. The tray bed 12 contains a teeing arm channel 83 which is especially designed for a teeing arm 77 to fit into. The teeing arm channel 83 is a recess on the tray bed 12 which has a shape of the teeing arm 77. The surrounding sides of the golf ball tray 11 are guard walls 18 which are orthogonal to the tray bed 12. The height of the top portion of the guard wall 18 with respect to the tray bed 12 is less than the diameter of a golf ball. The top portion of plurality of golf balls extend above the guard walls 18. In FIG. 6*a*, secured at the bottom of the teeing arm channel 83 are hook adhesive tapes 69.

In FIG. 2, underneath the golf ball tray 11 are golf tray support ribs 64 which are orthogonal to the tray bed 12. The golf tray supports ribs 64 provide rigidity to the golf ball tray 11 while keeping the total weight of the golf ball tray 11 to a minimum. Shown in FIG. 6*a* is a stow-away configuration wherein the forward bracket 22 and rear bracket 29 are folded underneath the golf ball tray 11. The golf tray support ribs 64 are situated such that they are out of the way of the forward bracket 22 and rear bracket 29. In FIG. 2, the guard walls 18 and golf tray support ribs 64 contain forward bracket pivot holes 62 and rear bracket pivot holes 63 which are situated below the tray bed 12 and oriented parallel to the tray bed 12.

FIG. 1 shows the teeing chamber 33 situated to the left end of the golf ball tray 11. The teeing chamber 33 consists of guard wall 18, a chamber bed 34 and a chamber ramp 35, a dividing wall 19, and a tray hump 14. The chamber ramp 35 is inclined downwards and towards chamber bed 34. The chamber bed 34 is inclined downwards to a teeing trough 36 (FIG. 2). The dividing wall 19 is a vertical wall that separates the teeing chamber 33 from the rest of the golf ball tray 11. The tray hump 14 is where the tray bed 12 and the chamber ramp 35 joins together to form a hump. The teeing trough 36 is a rectangular shaped aperture on the chamber bed 34. Attached at the front end of the teeing trough 36 are teeing arm pivot supports 75. The teeing arm pivot supports 75 are oriented in the horizontal direction and line up in a straight line. Each of the left and right side of the teeing though 36 contains a teeing arm pivot support 75 (FIG. 2). The top and side portions of the teeing arm pivot supports 75 contain an opening. The teeing arm pivot supports 75 are located below the chamber bed 34.

Figure 4:
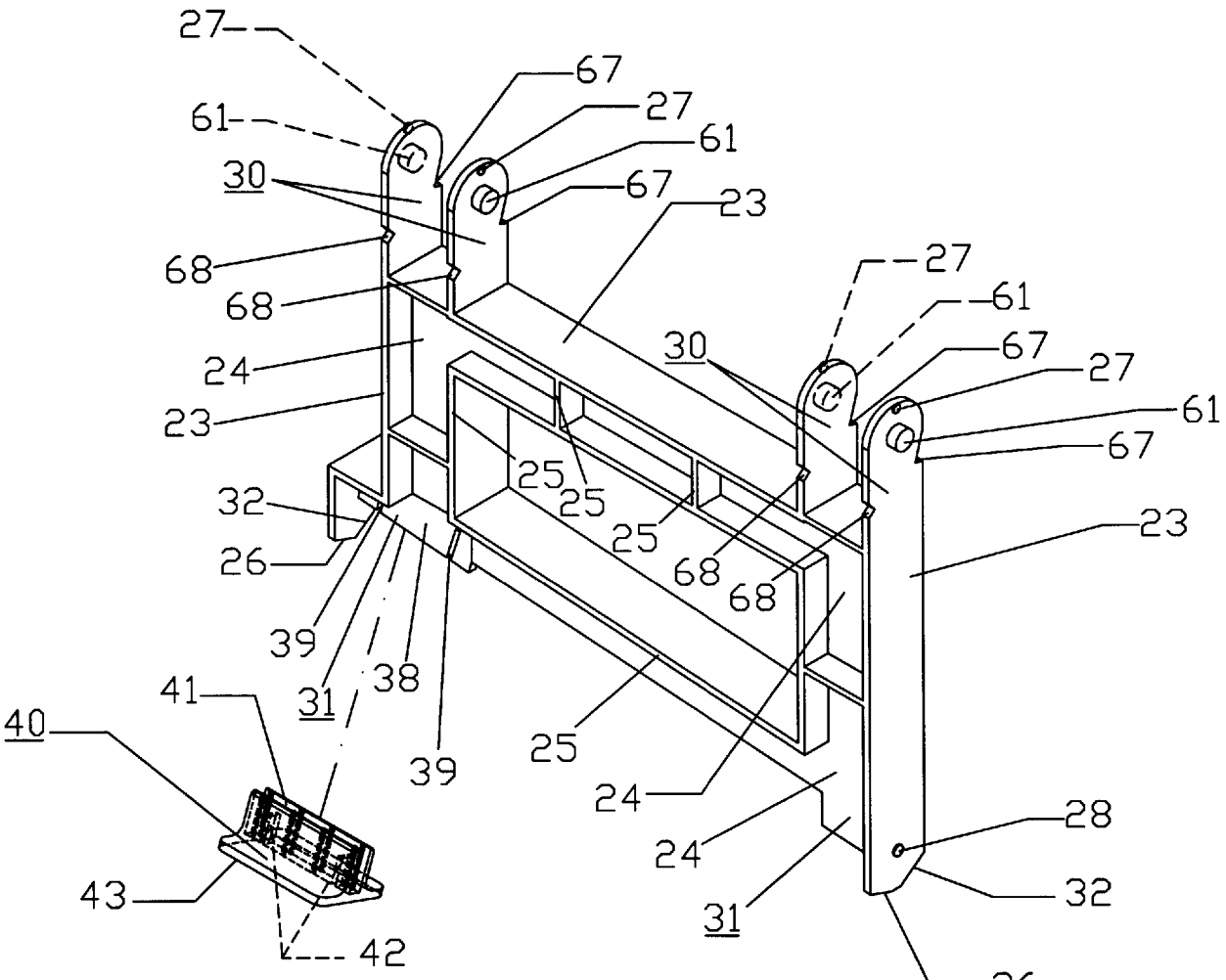
FIG. 4 shows an isometric, exploded view of the forward bracket and tee alignment adapter.

Referring to FIG. 4, the rear bracket 29 is dimensionally the same as the forward bracket 22. Further discussion of forward bracket 22 also relates to the rear bracket 29 since both are dimensionally equal. The forward bracket 22 contains bracket bed 24. The bracket bed 24 contains bracket walls 23 and bracket ribs 25. The bracket walls 23 and bracket ribs 25 extend evenly and perpendicularly to the front and back of the bracket bed 24. The bracket walls 23 and bracket ribs 25 provide rigidity to the forward bracket 22 while keeping the total weight of the forward bracket 22 to a minimum. The top portion of the forward bracket 22 consists of two upper bracket legs 30. The top portion of the upper bracket legs 30 contains bracket pivot tabs 61 which protrudes out of the bracket walls 23. The lower portion of the forward bracket 22 consists of two lower bracket legs 31. The left lower bracket leg 31 protrudes out in the horizontal direction. Attached to the left lower bracket leg 31 is an alignment tab 38. In a fully-deployed configuration (FIG. 1), the alignment tab 38 is orthogonal to a ground 74.

FIG. 1 shows the teeing machine in a fully-deployed configuration. The forward bracket 22 and rear bracket 29 support the golf ball tray 11. The bracket pivot tabs 61 of the forward bracket 22 are attached to the forward bracket pivot holes 62 (FIG. 2). Similarly, the bracket pivot tab 61 of the rear bracket 29 is attached to the rear bracket pivot holes 63 (FIG. 2). In FIG. 4, the forward bracket 22 and rear bracket 29 contain a forward bracket stop 67 and a rear bracket stop 68. The forward bracket 22 and rear bracket 29 contain lock tabs 28. In FIG. 2, attached underneath the golf tray bed 12 is a forward bracket support rib 65 which is located to the left of the forward bracket pivot hole 62. The forward bracket support rib 65 is orthogonal to the tray bed 12. Similarly, underneath the golf tray bed 12 is a rear bracket support rib 66 which is located to the right of the rear bracket pivot hole 63 and it is orthogonal to the tray bed 12. In a fully-deployed configuration, the forward bracket 22 is rotated clockwise until the forward bracket stop 67 rests at the forward bracket support rib 65. Similarly, the rear bracket 29 is rotated counterclockwise until the rear bracket stop 68 rests at the rear bracket support rib 66. Both the lock tabs 27 of the forward bracket 22 and rear bracket 29 latch on to lock holes 16 in order to keep the forward bracket 22 and rear bracket 29 from swiveling.

In FIG. 1, in a fully-deployed configuration the angle formed between the forward bracket 22 and the golf ball tray 11 is 106 degrees. Similarly, angle formed between the rear bracket 29 and the golf ball tray 11 is 131 degrees. In FIG. 4, the bottom portion of the forward bracket 22 and rear bracket 29 that rest on the ground 74 are forward bracket foot 26 and rear bracket foot 32, respectively. The forward bracket foot 26 and rear bracket foot 32 consist of a bracket wall 23 . In a fully-deployed configuration, the forward bracket foot 26 and rear bracket foot 32 are chamfered such that the forward bracket foot 26 and rear bracket foot 32 are parallel to the ground 74.

In FIG. 1, in a fully-deployed configuration, the forward bracket 22 and rear bracket 29 provide inclination to the golf tray bed 12. The golf tray bed 12 is inclined from the ground 74 such that golf tray bed 12 is inclined 4 degrees downwards (towards the golfer) and 4 degrees to the right. A plurality of golf balls would rest on the rightmost, bottom corner 13, away from the teeing chamber 33. The forward bracket 22 and rear bracket 29 provide inclination to the chamber bed 34 and chamber ramp 35. The chamber bed 34 is inclined 4 degrees downwards toward the teeing trough 36. The chamber ramp 35 is inclined 4 degrees towards the left and 4 degrees downwards toward the teeing trough 36.

FIG. 2 shows an alignment tab 38. The alignment tab 38 is oriented perpendicular to the ground 74. In FIG. 4, the alignment tab 38 contains tab keys 39. The tab keys 39 are slots that are located on the alignment tab. A tee alignment adapter 40 fits over the tab alignment tab 38. The tee alignment adapter 40 contains adapter slot 41, adapter keys 42, and adapter base 43. The adapter slot 41 is a thin slot on the tee alignment adapter 40 and it is orthogonal to the adapter base 43. Inside the adapter slot 41 are adapter keys 42. Adapter keys 42 are protrusions that are perpendicular to the adapter base 43 and the adapter keys 42 thickness is less than the tab keys 39 so that the adapter keys 42 fit into the tab keys 39. The alignment tab 38 can be slipped into the adapter slot 41 as long as the tab keys 39 line up with the adapter keys 42.

Referring to FIG. 2, attached to the bottom of the adapter base 43 is a mushroom head tape 84. The mushroom head tape 84 attaches to another mushroom head tape 84. The other mushroom head tape 84 is attached to one end of an alignment arm 46. A mushroom head tape 84 is utilized because the alignment between alignment arm 46 and tee alignment adapter 40 are more stable compared to hook and loop tape. The alignment arm 46 is generally an L-shaped, thin and elongated sheet. The other end of the alignment arm 46 is a tee hole 71. A rubber tee 47 is slipped through the tee hole 71. The alignment arm 46 is placed underneath a mat 72 and the rubber tee 47 is slipped through a mat hole.

Figures 3, 3A:
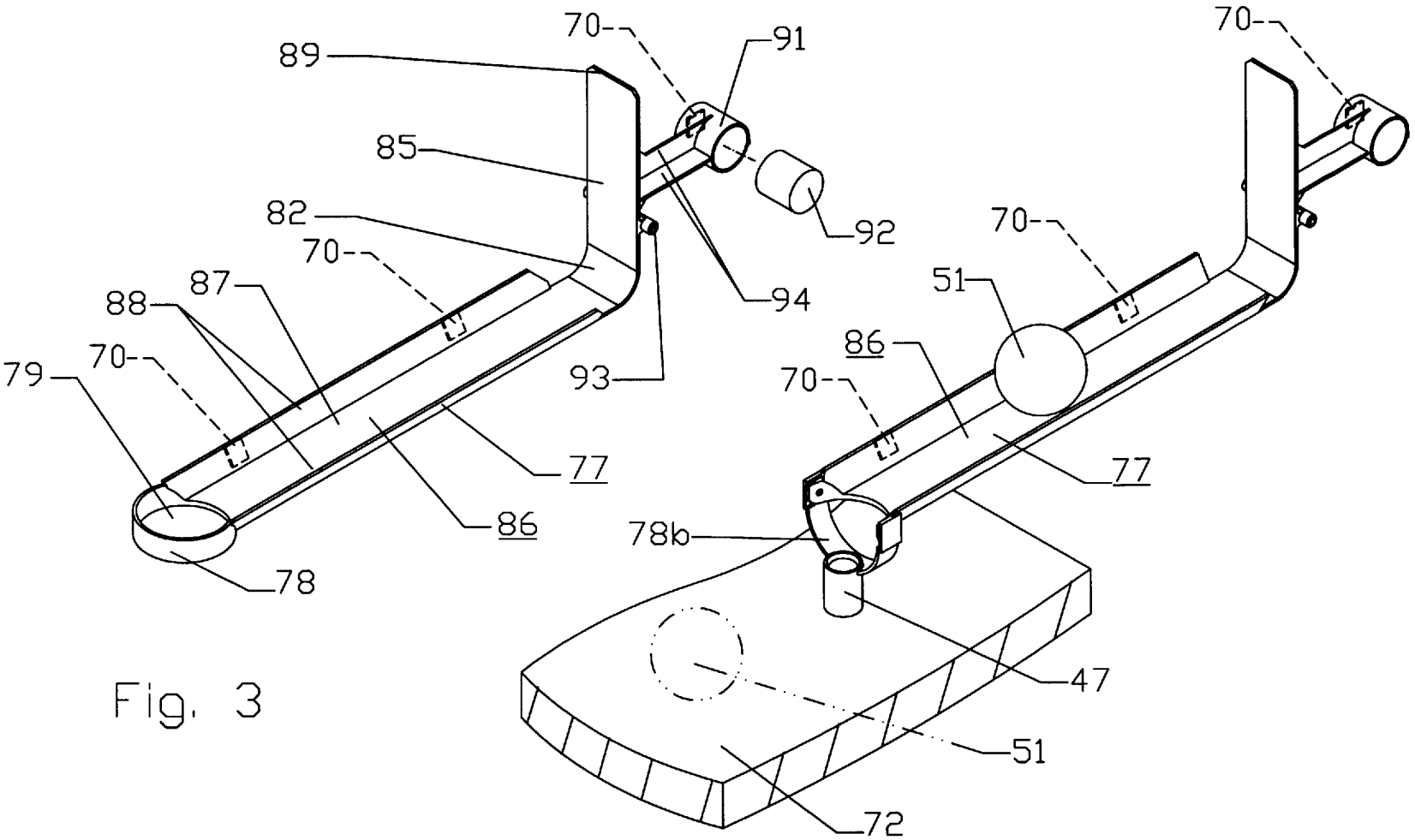
FIG. 3 shows an isometric view of the preferred embodiment of teeing arm.
FIG. 3*a* shows an isometric view of another embodiment of teeing arm.

In FIG. 3, the teeing arm 77 contains a delivery trough 86. The delivery trough 86 is formed with delivery walls 88 and delivery plate 87. The delivery walls 88 and delivery plate 87 are thin-walled and elongated in shape. The delivery trough 86 has the function of guiding a golf ball, and linking a tee ring 78 to a ball receiving plate 85. The tee ring 78 is a thin-walled cylinder which consists of a ring inner diameter 79. The ring inner diameter 79 is large enough to allow a golf ball to pass through. Orthogonally connected at one end of the delivery trough 86 is the ball receiving plate 85. Underneath the ball receiving plate 85 are plate supports 90, counterweight housing 91, and pivot 93 (FIG. 2). The plate supports 90 are oriented orthogonal to the ball receiving plate 85. The pivot 93 is an elongated cylinder and its length is longer than the width of the ball receiving plate 85. The pivot 93 is oriented parallel to the ball receiving plate 85 such that its two ends extends out of the ball receiving plate 85. Referring to FIG. 2, the counterweight housing 91 is a hollow cylindrical shaped housing which is oriented parallel to the pivot 93, and it is mounted below and to the right of the pivot 93. In FIG. 3, a counterweight housing support 94 supports the counterweight housing 91. Secured inside the counterweight housing 91 is a counterweight 92.

In FIG. 2, the teeing arm 77 fits into the teeing trough 36. The pivot 93 is supported and loosely fits into the teeing arm pivot support 75. A teeing chamber stop 37 prevents the teeing arm 77 from rotating clockwise by supporting a ball receiving lip 89 (FIG. 3). The ball receiving plate 85 is recessed below the chamber bed 34. The ball receiving plate 85 is also inclined downwards. On the teeing chamber 33, a teeing arm height adjustment screw 81 is utilized to adjust the height of the tee ring 78 with respect to the rubber tee 47 when a golf ball is being teed up.

Figures 3B, 3C:
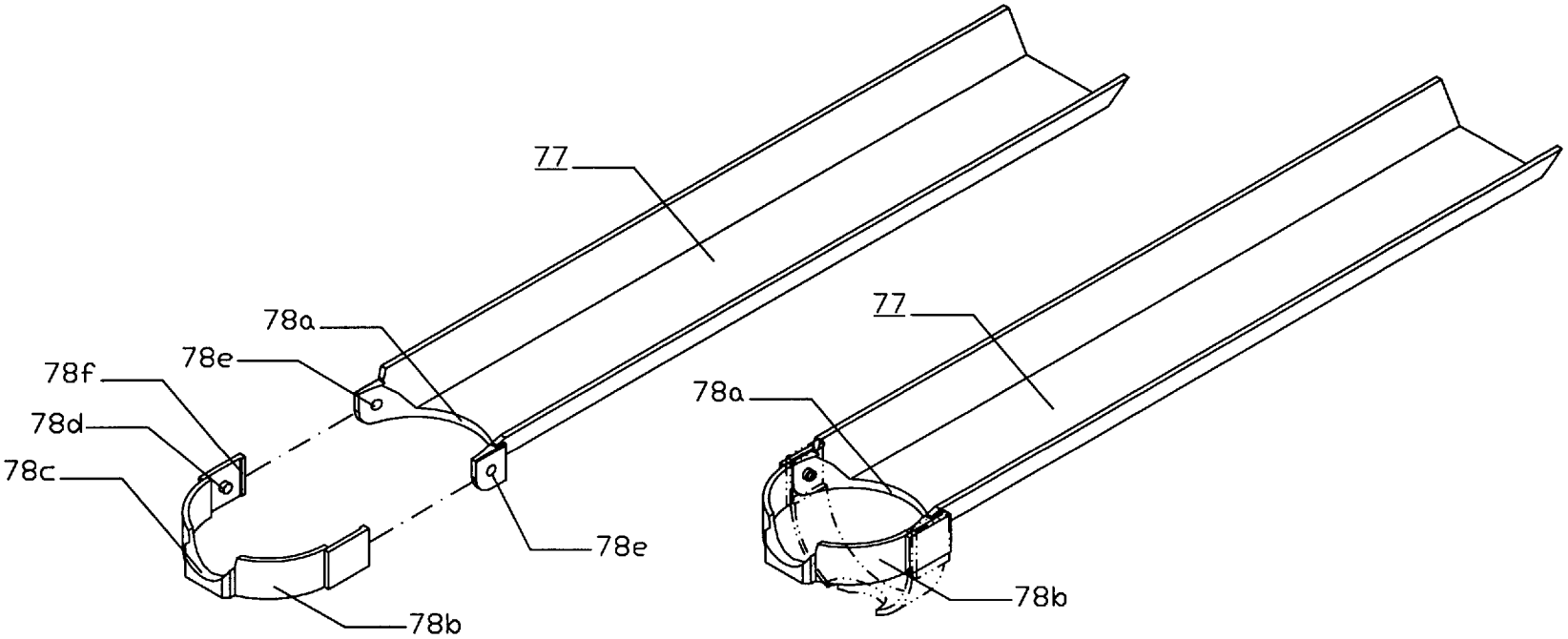
FIG. 3*b* shows isometric, exploded view of the fixed half ring and pivoting half ring.
FIG. 3*c* shows an isometric view of the fixed half ring and pivoting half ring in two different positions.

Another embodiment of the teeing arm 77 is shown in FIG. 3*a*. In FIG. 3*b*, one end of the teeing arm 77 consists of a fixed half ring 78*a*. The fixed half ring 78*a* is semi-circular in shape. Both ends of the fixed half ring 78*a* consists of ring pivot holes 78*e*. The ring pivot holes 78*e* are circular holes on the fixed half ring 78*b* and parallel to the pivot 93. Attached to the half ring 78*a* is a pivoting half ring 78*b*. The pivoting half ring 78*a* is semi-circular in shape. Both ends of the pivoting half ring 78*b* consist of ring pivots 78*d*. The ring pivots 78*d* are circular protrusions. The ring pivots 78*d* are latched to the ring pivot holes 78*e*. The pivoting half ring 78*b* contains ring tabs 78*f*. The ring tabs 78*f* are rectangular protrusions and the ring tabs 78*f* snap and hold the pivoting half ring 78*b* to two different positions. FIG. 3*c* shows the two different positions of pivoting half ring 78*b*. In first position, the pivoting half ring 78*b* is parallel to the fixed half ring 78*a*. The first position allows a golf ball to be teed up to the rubber tee 47. In second position, the pivoting half ring 78*b* is perpendicular and located below the fixed half ring 78*a*. This position allow a golf ball to be dispensed to the mat 72. The pivoting half ring 78*b* contains a ring notch 78*c*. The ring notch 78*c* is semi-circular cutout which clears the pivoting half ring 78*b* of the rubber tee 47 in second position.

OPERATION

FIG. 1 is an isometric view of the improved teeing machine in a fully-deployed configuration. Normally, the delivery trough 86 is oriented in the vertical position. The counterweight 92 causes the teeing arm 77 to rotate clockwise at the pivot 93. However, the ball receiving lip 89 rests on the teeing chamber stop 37 so the delivery trough 86 remains in a vertical position.

A golfer would need to place a plurality of golf balls into the golf ball tray 11. A plurality of golf balls would rest to the rightmost, bottom corner 13 of the golf ball tray 11. In FIG. 1, a row of golf balls 60, which are closest to the teeing arm channel 83, do not fall or get stuck into the teeing arm channel 83 because the teeing arm channel 83 is too narrow for golf balls to get stuck into. The corrugated guard wall 17 causes a plurality of golf balls to be arranged in an alternating pattern such that, as an example, a golf ball 55 sits in between golf ball 53 and golf ball 54. This pattern allows to utilize a narrower golf ball tray 11. The top portion of a plurality of golf balls extend out of the guard walls 18.

A golfer needs a golf club 49 to tee up a golf ball to the rubber tee 47. In FIG. 1, with a golfer normally holding a golf club 49 with his hand, he could move a leftmost, bottom golf ball 51 to the teeing chamber 33. The leftmost, bottom golf ball 51 is the most favorable golf ball to move among golf balls 51, 56, and 57. The leftmost, bottom golf ball 51 can be scooped by a golf club head 49*a* by placing the golf club head 49*a* at an angle in between the leftmost, bottom golf ball 51 and a golf ball 52. The leftmost, bottom golf ball 51 would rest on a golf club face 50 because the tray bed 12 is inclined towards the golfer and to the right. Now with the golf ball 51 resting against a golf club face 50, the golfer could slide the leftmost, bottom golf ball 51 towards the teeing chamber 33. A golfer can easily move the golf club 49 by sliding the bottom portion of the golf club head 49*a* on guiding rail 20. Shown in FIG. 2 is a guide stop 21. A guide stop 21 stops the golf club 49 from further forward movement. The golf ball 51 would have reached the tray hump 14 even before the golf club face 50 touches the guide stop 21. As the golf ball 51 slides past the tray hump 14, the leftmost, bottom golf ball 51 would roll down the chamber ramp 35 and into the ball receiving plate 85. The guide stop 21 also serves to keep the golf club 49 from hitting the teeing arm 77. After the golf ball 51 has been moved to the teeing chamber 33, the golf balls 56, 57, and 58 would move down toward the front of guard wall 18.

Figure 5:
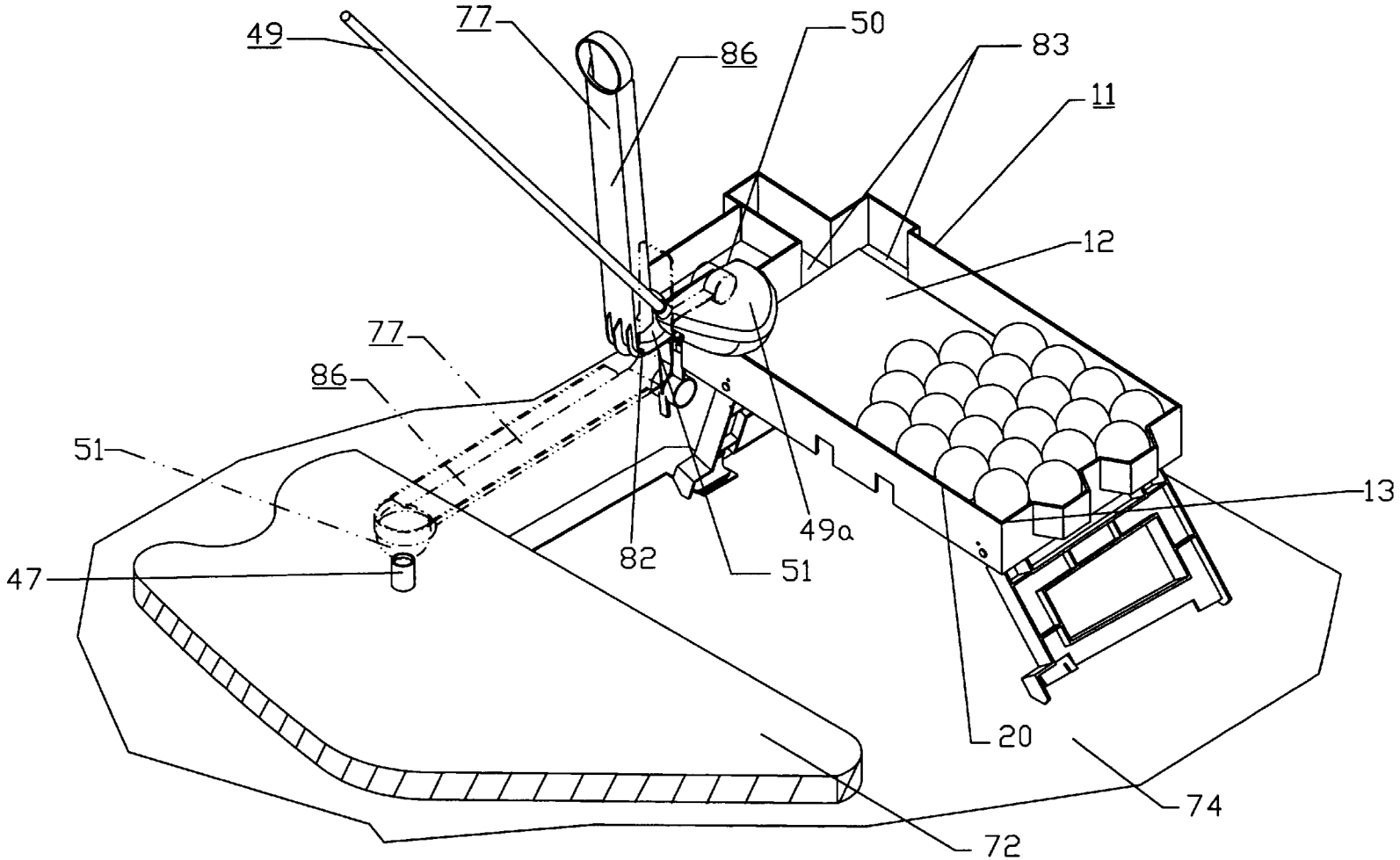
FIG. 5 shows an isometric view of how the improved teeing machine tees up a golf ball.

In FIG. 5, the ball receiving plate 85, which is inclined downwards and recessed below the chamber bed 34, would cause the golf ball 51 to roll towards a teeing arm corner 82. When the golf ball 51 reaches the teeing arm corner 82, the weight of the golf ball 51 would cause the whole teeing arm 77 to rotate counterclockwise. As the teeing arm 77 rotates counterclockwise towards the rubber tee 47, the teeing arm 77 would come to a stop when the teeing arm stop tab 80 hit against the teeing arm adjustment screw 81. The teeing arm adjustment screw 81 is adjusted such that the delivery trough 86 is inclined downwards and towards the rubber tee 47. The inclined delivery trough 86 causes the golf ball 51 to roll towards the tee ring 78. Once the golf ball 51 reaches the tee ring 78, the golf ball 51 would go through the tee ring 78 because the ring inner diameter 79 has enough clearance to allow the golf ball 51 to pass through. The golf ball 51 would drop on top of the rubber tee 47. When the golf ball 51 is fully seated on top of the rubber tee 47, the delivery trough 86 is now relieved of the weight of the golf ball 51. The counterweight 92 would cause the whole teeing arm 77 to rotate clockwise. The delivery trough 86 settles in the vertical orientation when ball receiving lip 89 stops on the teeing chamber stop 37.

At this time, the golfer is now ready to hit the golf ball 51 off the rubber tee 47. After hitting the golf ball 51, the golfer can repeat the same process again to tee up another golf ball. After repeated teeing of golf balls and reloading of golf balls into the golf ball tray 11, the teeing machine could be disturbed from its original position. The alignment arm 46 keeps the teeing machine in alignment with the rubber tee 47 no matter what position the golf tray 11 is in.

Typically, in a driving range, range golf balls come in different conditions. Condition of range golf balls range from very good to poor. One feature of the improved teeing machine is that it allows a golfer to choose a golf ball to tee up to the rubber tee 47. In FIG. 1, a golfer could choose between golf balls 51, 56, or 57 to tee up.

Figure 6:
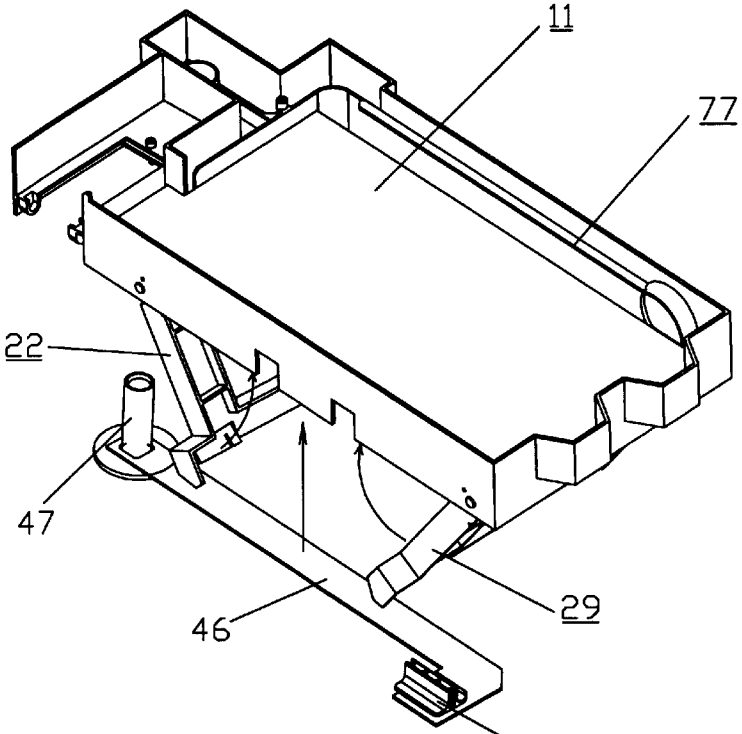
FIG. 6 shows an isometric view of the teeing arm being stowed away into the teeing arm channel and the forward and rear bracket being folded underneath the golf ball tray.

After a golfer is done hitting golf balls, the improved teeing machine can be stowed away. FIGS. 6 and 6*a* show how the improved teeing machine is stowed away. In a stow-away configuration, the teeing arm 77 comes off the teeing chamber 33 and the teeing arm 77 fits into the teeing arm channel 83. The teeing arm 77 contains loop adhesive tapes 70 as shown in FIGS. 3 and 3*a*. The loop adhesive tapes 70 engages the hook adhesive tapes 69, which are secured to the bottom of the teeing arm channel 83, and secures the teeing arm 77 to the teeing arm channel 83. When the teeing arm 77 is fully seated in the teeing arm channel 83, no portion of the teeing arm 77 extends past the guard walls 18. The tee alignment adapter 40 is pulled out of the alignment tab 38. The alignment arm 46 and tee alignment adapter 40 are kept together by the mushroom head tape 84. It is important that the alignment between alignment arm 46 and the tee alignment adapter 40 not disturbed by keeping the mushroom head tapes 84 intact. For the next teeing session, all a golfer has to do is to slip in the alignment adapter 40 to the alignment tab 38; the rubber tee 47 is in alignment with the tee ring 78.

In FIG. 6*a*, the forward bracket 22 and rear bracket 29 are folded flush with the bottom of the tray bed 12. The forward bracket 22 and rear bracket 29 have lock tabs 28 (FIG. 4) that latches unto lock holes 15 (FIG. 2) to keep the forward bracket 22 and rear bracket 29 locked and flushed with the bottom portion of the guard walls 18. Depending on the rubber tee 47 diameter, the rubber tee 47 could be left in or slid out of the tee hole 71. The tee alignment adapter 40 can be fitted to an alignment adapter channel 44. The alignment adapter channel 44 is located underneath the golf ball tray 11. Hook and loop tapes 45 secure the alignment arm 46 to the golf tray support rib 64. The improved teeing machine can be stowed away by a golfer in his golf bag or car trunk.

Referring to FIG. 3*c*, in a position where the pivoting half ring 78*b* is parallel to the fixed half ring 78*a*, a plurality of golf balls are teed to the rubber tee 47. If a golfer wants to dispense golf balls to the mat 72, the golfer has to rotate the pivoting half ring 78*b* counterclockwise until the pivoting half ring 78*b* snaps perpendicular to the fixed half ring 78*a* as shown in FIG. 3*c*. In FIG. 3*a*, as the golf ball 51 rolls down the delivery trough 86, the golf ball 51 would roll past the rubber tee 47 and onto the mat 72 since there is no pivoting half ring 78*b* to stop the downward movement of the golf ball 51.

CONCLUSIONS, RAMIFICATIONS, AND SCOPE OF INVENTION

The reader will see that this teeing machine has advantages over the prior arts. The improved teeing machine has a capacity of about 35 golf balls. This is a reasonable golf ball capacity for a portable teeing machine considering that a bucket of golf balls holds about 70 golf balls. The improved teeing machine can be disassembled from a fully-deployed configuration into a small package (stow-away configuration). The majority of existing teeing machines cannot be disassembled to a smaller package. The improved teeing machine, with its small dimension (approximately 17.5 inches by 8.0 inches by 2.0 inches in dimension) and light weight, can be stored in most golf bags. Existing designs are bulky and heavy that the only place where they could be stored is in a trunk of a car or they have to be bolted down permanently at golf ranges.

Setting up and tearing down the improved teeing machine is easily done and there are no tools required. The teeing machine can be easily assembled and disassembled in minutes. Utilizing a counterweighted teeing arm 77 relieves a golfer from the delicate operation of a spring-loaded teeing arm.

With the use of a ground-engaging tee, the improved teeing machine can be used on a grass or bare-ground. The improved teeing machine can be made of metal or plastic, or manufactured in different colors or with transparent plastic material. The shape of the golf ball tray 11 or the teeing chamber 33 can be made in different shapes.

In FIG. 1, the preferred embodiment of the improved teeing machine contain five rows of golf balls. The golf tray II can be designed to contain four or fewer rows of golf balls.

In FIG. 1, the improved teeing machine is designed for the right-handed golfers. Other ramification of this teeing machine would be designing the improved teeing machine for the left-handed golfers wherein the teeing chamber 33 is located to the right side of the golf tray II and the plurality of golf balls would settle towards the golfer and towards the left, bottom corner of the golf tray 11.

Although the invention has been described with respect to a preferred embodiment thereof, it is to be understood that it is not to be so limited since changes and modifications can be made therein which are still within the full intended scope of this invention as defined by the appended claims.

What I claim is:

1. A golf ball teeing machine comprising of:

a) a tray including means for holding a plurality of golf balls, a ramp for rolling down said plurality of golf balls, and side walls for containing said plurality of golf balls in said holding means;

b) means for elevating said tray, wherein said elevating means is adapted to bias said tray such that said plurality of golf balls, lying on said holding means, are caused to settle against said side walls and away from said ramp;

c) a teeing arm for transmitting said plurality of golf balls from said ramp to a tee or ground, said teeing arm pivotally attached to said ramp such that when one of said plurality of golf balls gravitationally rolls down the inner portion of said teeing arm, the weight of the said golf ball causes the teeing arm to rotate in one direction, said teeing arm including a ring on one end such that said ring is utilized to align and drop said golf ball to said tee or said ground, said teeing arm further including a counterweight to rotate said teeing arm in an opposite direction after the golf ball has been dropped to said tee or said ground;

d) alignment means for aligning said ring to said tee.

2. The golf ball teeing machine of claim 1, wherein said teeing arm is removable from said ramp.

3. The golf ball teeing machine of claim 1, wherein said tray further includes a channel for allowing said teeing arm to fit in such that when said teeing arm is fitted in said channel, said teeing arm is completely within said tray.

4. The golf ball teeing machine of claim 3, wherein said teeing arm is secured to said channel by a hook and a loop tape.

5. The golf ball teeing machine of claim 1, wherein said elevating means comprises a forward bracket and a rear bracket, said brackets being pivotally mounted to the underside of said golf tray such that when said brackets are fully deployed, said brackets elevate said tray off said ground and bias said tray such that said plurality of golf balls, laying on top of said holding means, settle against said side walls and away from said ramp and towards a golfer.

6. The golf ball teeing machine of claim 1, wherein the top portion of said side walls has a distance from the top portion of said holding means less than the height of said golf ball, such that when said plurality of golf balls are laying on top of said holding means, the top portion of the said golf balls are above the top portion of said side walls.

7. The golf ball teeing machine of claim 5, wherein said forward bracket and said rear bracket are dimensionally the same.

8. The golf ball teeing machine of claim 5, wherein the alignment means comprises an alignment arm, a mushroom tape, and an alignment adapter, said alignment arm being a long and flat sheet with two ends, one of said ends having an aperture to fit the neck of said tee, the base of said alignment adapter being attached to the other end of said alignment arm by the said mushroom tape, and the alignment adapter including a channel which is orthogonal to said base of said alignment adapter.

9. The golf ball teeing machine of claim 8, wherein said brackets comprise an alignment tab at one of the feet of said brackets, said alignment tab being orthogonal to said ground when said forward bracket is fully deployed, and said alignment tab being adapted for receiving said channel of said alignment adapter.

10. The golf ball teeing machine of claim 1, wherein the said teeing arm including a fixed half ring and pivoting half ring on one end, the said fixed half ring being adapted to be permanently attached to the said teeing arm, the said pivoting half ring being adapted to be pivotally mounted and snapped to two positions to the said fixed half ring, such that in first position the said pivoting half ring being positioned and snapped parallel to the said fixed half ring, and in second position the said pivoting half ring being positioned and snapped perpendicular and underneath the said fixed half ring.

11. The golf ball teeing machine of claim 1, wherein one of said side walls farthest from said ramp has corrugations such that when said plurality of golf balls lying on top of said holding means settle against said corrugations, said plurality of golf balls arranged in an alternating order.

12. The golf ball teeing machine of claim 1, wherein said tray, said elevating means, said teeing arm and said alignment means comprise an acrylonitrile, butadiene, and styrene (ABS) plastic material.

* * * * *